US007971457B2

(12) United States Patent
Aouad

(10) Patent No.: US 7,971,457 B2
(45) **Date of Patent: *Jul. 5, 2011**

(54) DEVICES FOR DISPENSING A LAUNDRY AGENT AND METHODS FOR DOING SAME

(75) Inventor: Yousef Georges Aouad, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 1066 days.

This patent is subject to a terminal disclaimer.

(21) Appl. No.: 10/986,947

(22) Filed: Nov. 12, 2004

(65) Prior Publication Data

US 2005/0130861 A1 Jun. 16, 2005

Related U.S. Application Data

(60) Provisional application No. 60/519,111, filed on Nov. 12, 2003.

(51) Int. Cl.
*D06F 39/02* (2006.01)

(52) U.S. Cl. ..... 68/207; 68/17 R; 222/500; 222/463

(58) Field of Classification Search ..... 68/207
See application file for complete search history.

(56) References Cited

U.S. PATENT DOCUMENTS

| | | | | |
|---|---|---|---|---|
| 2,970,463 | A | 2/1961 | Johnston | |
| 3,066,520 | A | 12/1962 | Jennings | |
| 3,095,722 | A * | 7/1963 | Fox | 68/207 |
| 3,174,647 | A * | 3/1965 | Ludwig | 222/52 |
| 3,670,530 | A | 6/1972 | Filipak | |
| 5,355,541 | A * | 10/1994 | Rutter et al. | 8/158 |
| 7,036,176 | B2 * | 5/2006 | Aouad et al. | 8/159 |
| 7,036,177 | B2 * | 5/2006 | Aouad et al. | 8/159 |
| 7,168,273 | B2 * | 1/2007 | Neergaard et al. | 68/17 R |
| 7,219,518 | B2 * | 5/2007 | Aouad et al. | 68/17 R |
| 2002/0100773 | A1 * | 8/2002 | Rodd et al. | 222/444 |
| 2002/0108969 | A1 * | 8/2002 | Rodd et al. | 222/209 |

FOREIGN PATENT DOCUMENTS

| | | | |
|---|---|---|---|
| DE | 3922342 | A1 * | 1/1991 |
| JP | 58-124487 | * | 7/1983 |
| WO | WO 03/069042 | A1 | 8/2003 |

* cited by examiner

*Primary Examiner* — Michael Barr
*Assistant Examiner* — Jason P Riggleman
(74) *Attorney, Agent, or Firm* — Melissa G. Krasovec; David V. Upite; Leonard W. Lewis

(57) ABSTRACT

The present invention relates to a dispenser for laundry additives comprising a base and a reservoir separated by an insert. The present invention further relates to a method of dispensing a laundry additive in an automatic washing machine comprising mounting a dispenser having a base and a reservoir within the automatic washing machine; adding the laundry additive to the reservoir; positioning an insert to seal the laundry additive within the reservoir; actuating the insert with centrifugal force in order to open the reservoir; releasing the laundry additive from the reservoir onto the base; and dispersing the laundry additive from the base within the automatic washing machine.

14 Claims, 4 Drawing Sheets

DEVICES FOR DISPENSING A LAUNDRY AGENT AND METHODS FOR DOING SAME

CROSS REFERENCE TO RELATED APPLICATIONS

This application claims priority to U.S. Provisional Application Ser. No. 60/519,111, filed Nov. 12, 2003.

FIELD OF THE INVENTION

The present invention relates to dispensers adapted to release one or more laundry agents where the release mechanism is actuated by centrifugal forces, such as by the spin cycle of an automatic washing machine. It also relates to methods of releasing an agent by such dispensers. In particular, it relates to such dispensers when also adapted to contain a laundry additive.

BACKGROUND OF THE INVENTION

There are many types of laundry additives suitable for use in automatic washing machines for fabric laundering. Cleaning agents such as surfactants and detergent builders are used to assist in the mechanical removal of soil and stains from fabrics being laundered. Bleaching agents, enzymes and adjuvants relating thereto are designed to promote chemical degradation and removal of soils and stains. Fabric conditioners, softeners, anti-wrinkle agents, soil release materials and similar agents serve to alter and enhance the condition, appearance or feel of laundered fabrics. Other auxiliary materials, such as pH adjustment and control agents, buffers, solvents, dispersants, anti-redeposition agents, dye transfer inhibitors, stabilizers, preservatives, perfumes, dyes and the like are used to alter the aqueous environment in the automatic washing machine drum to provide for optimum performance of the active laundry additive materials or to improve the quality or aesthetics of commercialized laundry products containing these active additive materials.

The types of laundry additives described hereinbefore, frequently intermingled or admixed together in a wide variety of combinations for convenience, are commonly marketed to consumers in bulk quantities, in either solid, i.e. granular or tablet, or liquid form.

Consumers carrying out the laundering operation generally add doses or aliquots of this intermingled or admixed product to the automatic washing machine. In the majority of cases a single product is added to the automatic washing machine, for instance directly into the drum or into a dispensing drawer, prior to beginning the automatic washing process.

However, certain laundry additive materials are most effective when introduced to the process at some time after the automatic washing process has begun. For instance, laundry additives intended to enhance the condition, appearance or feel of laundered fabric, such as fabric conditioners, softeners, anti-wrinkle agents, etc., are most effective when added during the rinse cycle, which takes place after the main washing cycle. Indeed, some are ineffective if added prior to the rinse cycle. This can create the need for the consumer to return to the automatic washing machine at some point during the automatic washing process, such as at the beginning of the rinse cycle to add materials which are to function at this later point, e.g. during the rinse cycle.

Therefore, various systems have been developed which permit the consumer to place laundry additives material into devices or dispensers at the beginning of the automatic washing process with those devices or dispensers serving to add the laundry additives to the automatic washing process automatically at a predetermined later stage of the process. These systems have been particularly concerned with introducing laundry additives into the rinse cycle automatically.

One type of system used for introducing laundry additives into the rinse cycle automatically includes rinse water dispensers. These dispensers are typically filled with a laundry additive and placed in the automatic washing machine at the beginning of the cycle. While these devices have grown in popularity, they do have room for improvement. One difficulty associated with such a dispenser is that it must be found in the laundry at the end of the wash cycle. Often these devices still have laundry additive or rinse water remaining inside, necessitating the removal of these compositions from the dispenser. Further, these devices can be difficult to fill and seal.

Automatic washing machine drums are apertured in order to allow entry of water into the drum, and these apertures could potentially provide a convenient means for attaching such devices or dispensers with the use of a hook-based system. However, it is important that any attachment system is secure and does not raise significant risk of the device or dispenser becoming detached from the inner surface of the drum during the washing process. The drum is moving during a significant proportion of the process and, in particular, spins rapidly during the spin cycle.

Dispensing of rinse laundry additives in accordance with this invention takes place in an automatic washing machine. Such automatic washing machines are those typically found in the home or in businesses such as self-service laundromats wherein individual consumers can launder their own loads of fabrics.

It is, therefore, desirable to provide a more convenient and efficient dispenser capable of dispensing a laundry additive to the rinse cycle. It is also desirable to add the laundry additive at the beginning of the main washing cycle for the dispensing during the rinse cycle. It is further desirable to provide a dispenser that can be removably attached to the drum of an automatic washing machine. The present invention solves these problems.

SUMMARY OF THE INVENTION

The present invention relates to a dispenser for laundry additives comprising a base and a reservoir separated by an insert. In one embodiment the present invention further comprises a secondary distributor. In a preferred embodiment, the secondary distributor is located within the dispenser. In another embodiment, the dispenser further comprises a reservoir vent. In still another embodiment, the dispenser further comprises a base vent.

In one embodiment the reservoir is made of plastic. In a more preferred embodiment the plastic is a low surface energy plastic. In an even more preferred embodiment, the low surface energy plastic is selected from the group consisting of polyolefins, Ethylene Propylene Diene Monomer ("EPDM"), polyacetals; polyesters; polyamides; and combinations, composites and copolymers thereof.

In one embodiment the base is made of plastic. In another embodiment the plastic is a low surface energy plastic. In yet another embodiment the low surface energy plastic is selected from the group consisting of polyolefins, EPDM, polyacetals; polyesters; polyamides; and combinations, composites and copolymers thereof.

In one embodiment the reservoir has a volume of 0.5 ml to about 1000 ml. In another embodiment, the reservoir is moveably connected to the base. In yet another embodiment, the reservoir is fixed on the base.

In one embodiment the reservoir contains more than one compartment. In another embodiment, the insert substantially seals the reservoir. In one embodiment the insert is made of plastic. In a more preferred embodiment the plastic is selected from the group consisting of silicone, polyolefins, EPDM, polyacetals; polyesters; polyamides; and combinations, composites and copolymers thereof.

In one embodiment the insert is a diaphragm. In a more preferred embodiment the diaphragm is made of silicone. In another embodiment the insert is a slit valve. In a more preferred embodiment, the slit valve is made of EPDM.

In one embodiment the insert is actuated by centrifugal force. In another embodiment the insert is functionally attached to the base. In yet another embodiment the insert is functionally attached to the reservoir.

In one embodiment the dispenser is affixed to the to the washing machine drum by an attachment means. The present invention further relates to various combinations of the elements described herein.

The invention also relates to a method of dispensing a laundry additive in an automatic washing machine comprising mounting a dispenser having a base and a reservoir within the automatic washing machine; adding the laundry additive to the reservoir; positioning an insert to seal the laundry additive within the reservoir; actuating the insert with centrifugal force in order to open the reservoir; releasing the laundry additive from the reservoir onto the base; and dispersing the laundry additive from the base within the automatic washing machine.

The invention further relates to a method of dispensing a laundry additive in an automatic washing machine comprising mounting a dispenser having a base and a reservoir within the automatic washing machine; adding the laundry additive to the reservoir; positioning an insert to seal the laundry additive within the reservoir; actuating the insert with centrifugal force in order to open the reservoir; releasing the laundry additive from the reservoir onto the base; depositing the laundry additive from the base to a secondary distributor; and dispersing the laundry additive from the secondary distributor within the automatic washing machine.

DETAILED DESCRIPTION OF THE INVENTION

Figure 1:
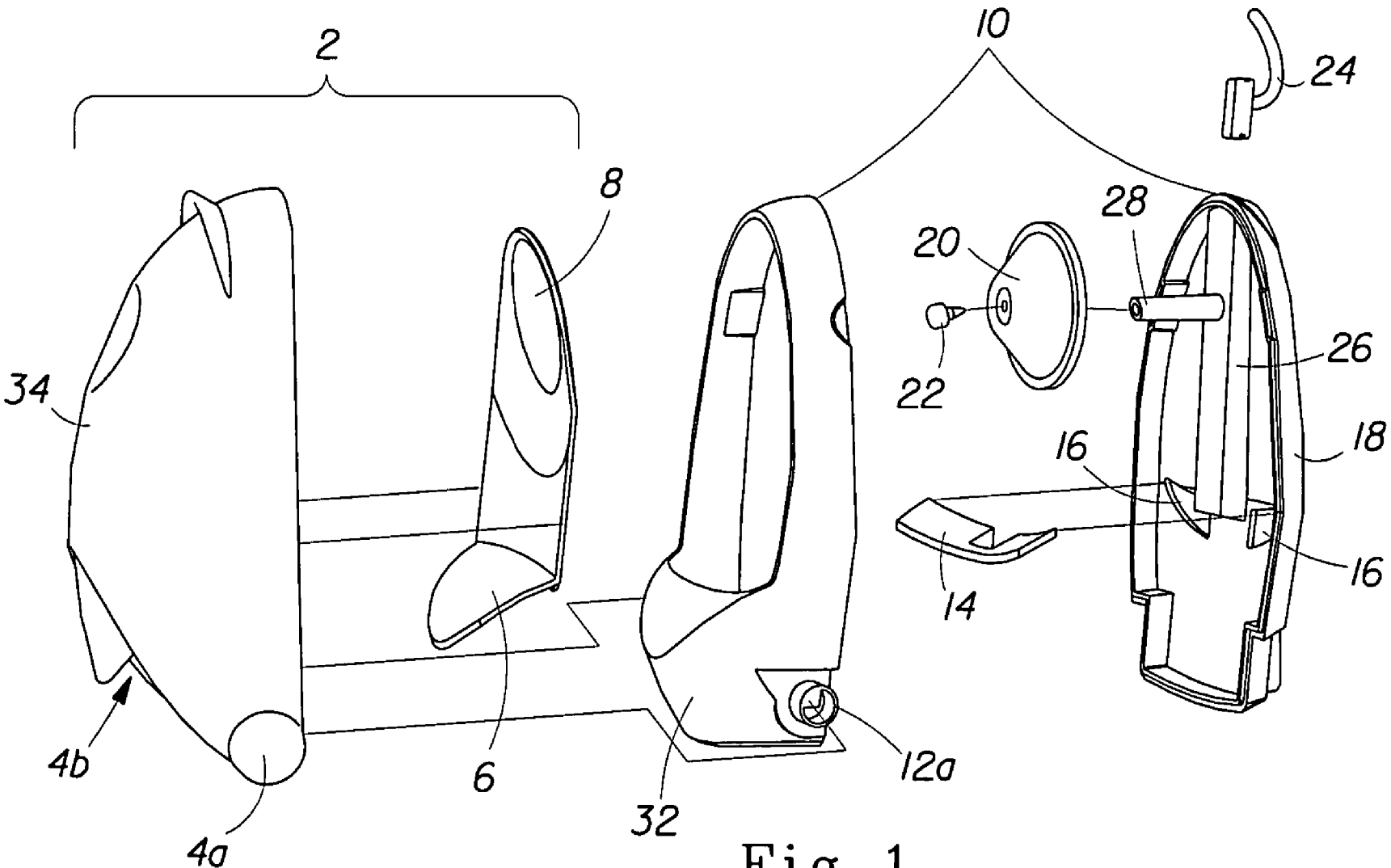
FIG. 1 of the drawings is an exploded front perspective view showing a first embodiment of the dispenser with a second compartment.

The present invention relates to the time specific dispensing of laundry additives into the drum of an automatic washing machine. The methods and dispensers of the present invention are intended to provide timed dispensing of laundry additives into the rinse cycle. Such laundry additives are dispensed into the washing machine as the machine proceeds through its spin cycles and rinse cycles as hereinbefore described. This is accomplished using a dispenser having a reservoir and a base separated by an insert. In one embodiment the insert is actuated by centrifugal force. In another embodiment, the dispenser is removably attached to the automatic washing machine. In yet another embodiment, the dispenser includes a secondary compartment where water from the rinse cycle contacts the laundry additive.

The dispenser may be of any suitable shape or configuration so long as it has a reservoir for containing the laundry additive and a base separated by an insert. The function and purpose of the dispenser is to protect the integrity of the laundry additive during the wash cycle(s). Accordingly, the dispenser may also be used to form at least part of the reservoir for the laundry additive. This may entail provision of an opening in the device fitted with a cap that can be opened in order to permit placement of the laundry additive and closed after the laundry additive has been placed into the dispenser. Alternatively, the dispenser may comprise of a base with a hinged reservoir that opens and closes to permit introduction of and subsequent protection for the laundry additive.

The Reservoir

The reservoir of the present invention can be made of any material that is capable of holding a laundry additive as well as withstanding continued use within an automatic washing machine. These materials include, but are not limited to, woods, metals, plastics, glasses, and ceramics. Plastics are preferred. A preferred material would have a low surface energy, less than about 42 dynes/cm, more preferably less than about 37 dynes/cm, even more preferably less than about 32 dynes/cm. Without wishing to be bound by theory, it is believed that a reservoir made from a material with a low surface energy inhibits the laundry additives from adhering to the reservoir, resulting in a more complete transfer of the laundry additive and maintaining a cleaner dispenser. Such low surface energy materials include, but are not limited to plastics such as polyolefins, including polypropylene, polyethylene, and polybutylene; EPDM; composite rubber materials, such as the microdispersed polypropylene/EPDM rubber material commercially available under the trademark Santoprene® from Monsanto Company (St. Louis, Mo.); polyacetals; polyesters, e.g., polybutylene terephthalate; polyamides, e.g., nylon; fluorocarbon polymers, e.g., Teflon® polytetrafluoroethylene (E. I. duPont de Nemours and Company, Inc., Wilmington, Del.); etc., including combinations and composites of such materials, and copolymers of the monomers of such polymers.

The reservoir of the present invention can utilize a range of sizes for its operation. The size of the reservoir will vary directly with the size of the automatic fabric washing machine and the strength of the rinse agent. One of ordinary skill in the art would readily know what size reservoir would be needed for a given potency of laundry agent. In a preferred embodiment, the reservoir has a volume of from about 0.5 ml to about 1000 ml, more preferably from about 1 ml to about 500 ml, most preferably from about 10 ml to about 100 ml.

In one embodiment the reservoir has an orifice. This orifice is utilized to add laundry additives to the reservoir when filling the dispenser. After the dispenser is filled and as the insert is actuated by the spin cycle, the laundry additive flows out of the reservoir back through the orifice. In another embodiment, the reservoir has an inlet and an outlet. The inlet is used to add laundry additives to the reservoir when filling the dispenser. The inlet can be opened and closed from the outside of the dispenser. In one embodiment, a cap is removably attached to the inlet. The cap is removed when the dispenser is being filled with laundry additive and replaced after filling in such a manner that prevents the laundry additive from exiting from the inlet or other material from entering the inlet. Once the insert is actuated by the spin cycle, the laundry additive exits the reservoir through the outlet.

Optionally, the reservoir can contain a reservoir vent. The reservoir vent is sized, positioned, and designed in such a manner that it would allow gases to enter or exit the reservoir, but would not allow laundry additive or water to enter or exit the reservoir. The reservoir vent preferably has an area from about 0.001 to about 100 $mm^2$. In one embodiment, the reservoir vent contains a vent valve. The vent valve would further prevent liquid materials from entering from the outside of the dispenser. Any vent valve known in the art capable of preventing liquid materials from entering from the outside of the dispenser through the reservoir vent can be utilized. Such vent valves include, but are not limited to, check valves, slit valves, and ball valves.

The reservoir can be made from one continuous piece of material or it can be made multiple components. In a preferred embodiment, the reservoir is made from a lid and a proximal surface that are shaped in such a manner that when they are fitted together, they can contain a laundry additive.

The proximal surface surrounds the opening or the outlet. In a preferred embodiment, the proximal surface is upwardly sloped toward the automatic washing machine, peaking at or near the orifice or the outlet. Without wishing to be bound by theory, it is believed that the slope of the proximal surface guides the laundry additive out of the orifice or the outlet during spinning of the washing machine drum.

In one embodiment the reservoir is movably attached to the base of the dispenser. Moveably attaching the reservoir to the base of the dispenser can be done by any method known in the art. Such methods of moveably attaching include, but are not limited to, pivots, hinges, clipping mechanisms, interlocks, tongue and groove, magnets and electromagnets, suction cups, mechanical fasteners, buttons, snaps, and Velcro®. In such an embodiment, it is preferred that the reservoir has only the orifice to facilitate the use of the dispenser.

In another embodiment, the reservoir is fixed on the base of the device. Any method known in the art of securing the reservoir to the base can be used. Such methods of securing the reservoir include gluing, melting, screwing, nailing, stapling, and interference fittings. In such an embodiment, it is preferred that the reservoir be of the type having both the inlet and the outlet to facilitate the use of the dispenser.

Of course, the reservoir may utilize more than one compartment for laundry additives. This may be useful when two laundry additives are incompatible with each other and may be desirably separated until they are added to the automatic washing machine drum. The reservoir may also optionally contain separate compartments for additional laundry additives if the dispenser is configured to dispense laundry additives in the wash cycle in addition to the rinse cycle.

The Base

The base of the present invention performs several functions. In one embodiment, the reservoir is moveably attached to the base of the dispenser. In another embodiment, the reservoir is fixed to the base. The base contains at least one compartment capable of holding an amount of the laundry additive during the spin cycle. Optionally, the base contains a second compartment where the laundry additive is deposited upon completion of the spin cycle.

The base of the present invention can be made of any material that is capable of holding a laundry additive as well as withstanding continued use within an automatic washing machine. The base can be made from one continuous piece of material or it can be made from multiple components. These materials include, but are not limited to, woods, metals, plastics, glasses, and ceramics. Plastics are preferred. A preferred material would have a low surface energy, less than about 42 dynes/cm, more preferably less than about 37 dynes/cm, even more preferably less than about 32 dynes/cm. Without wishing to be bound by theory, it is believed that a base made from a material with a low surface energy inhibits the laundry additives from adhering to the base, resulting in a more complete transfer of the laundry additive and maintaining a cleaner dispenser. Such low surface energy materials include, but are not limited to plastics such as polyolefins, including polypropylene, polyethylene, and polybutylene; EPDM; composite rubber materials, such as the microdispersed polypropylene/EPDM rubber material commercially available under the trademark Santoprene® from Monsanto Company (St. Louis, Mo.); polyacetals; polyesters, e.g., polybutylene terephthalate; polyamides, e.g., nylon; fluorocarbon polymers, e.g., Teflon® polytetrafluoroethylene (E. I. duPont de Nemours and Company, Inc., Wilmington, Del.); etc., including combinations and composites of such materials, and copolymers of the monomers of such polymers.

During the spin cycle, the laundry additive flows from the reservoir through the orifice or the outlet onto the base. Without wishing to be bound by theory, it is believed that the centrifugal force generated by the spin cycle actuates the insert and draws the laundry additive through the outlet or opening onto the base. Preferably the base has a design that will aid in holding the laundry additive on the base during the spin cycle, yet allow its release after the completion of the spin cycle. Designs capable of such function may include those where the base contains a flange, a lip or a deflector located below the orifice. The flange, lip or deflector provides increased holding of the laundry additive on to the base during the spin cycle, and allows the flow of the laundry additive from the base after the spin cycle is complete. In a preferred embodiment, any flange, lip or deflector is attached to the base at an angle greater than about 5% from parallel with respect to the drum. During the spin cycle, the base should be able to hold at least 50% of the reservoir volume, more preferably at least 70% of the reservoir volume, most preferably at least 90% of the reservoir volume. By having the dispenser hold the released laundry additive on the base until the spin cycle stops, the laundry additive can thereby be kept from being washed out of the automatic washing machine drum by being forced out of the automatic washing machine drum through the apertures in the drum during the spin cycle.

Optionally, the base can contain a base vent. The base vent is sized, positioned, and designed in such a manner that it would allow gases to enter or exit the reservoir, but would not allow laundry additive or water to enter or exit the reservoir. The base vent preferably has an area from about 0.001 to about 100 $mm^2$. In one embodiment, the base vent contains a vent valve. The vent valve would further prevent liquid materials from entering from the outside of the dispenser. Any vent valve known in the art capable of preventing liquid materials from entering from the outside of the dispenser through the base vent can be utilized. Such vent valves include, but are not limited to, check valves, slit valves, and ball valves.

In one embodiment, the base has an exit opening to allow the laundry additive to exit the base and/or the dispenser. In such an embodiment, the exit opening is located in the base such that the force of gravity on the laundry additive will direct the laundry additive through the exit opening.

Optionally, the dispenser can be position on the washing machine drum in such a manner that rinse water can enter the dispenser through the exit opening. The rinse water can enter the dispenser through the exit opening in the base before or during the exiting of the laundry additive. In one embodiment, the rinse water only contacts the base. In another embodiment, the rinse water flows through the orifice or the outlet into the reservoir. Without wishing to be bound by theory, it is believed that the rinse water cleanses the dispenser by transporting a substantial portion of any laundry additive that may remain in the dispenser. The entry of rinse water into the dispenser is aided by the presence of the reservoir vent and/or base vent. It is believed that the reservoir vent and/or base vent allows any gases remaining in the dispenser to be displaced by the rinse water, said gases exiting the dispenser through the reservoir vent and/or base vent.

Secondary Distributor

In one embodiment, the laundry additive is deposited from the base into or on a secondary distributor upon completion of the spin cycle. In this embodiment the exit opening is oriented in such a manner that the laundry additive is deposited into or on the secondary distributor upon completion of the spin cycle. In one embodiment, the secondary distributor is housed within the dispenser. In another embodiment, the secondary distributor is located outside of the dispenser. The secondary distributor is positioned in such a manner that it is below the uppermost water line of the rinse cycle. Without wishing to be bound by theory, the secondary distributor functions by gathering the laundry additive and distributing the laundry additive in such a manner that it is not directly applied to the clothes. Such a function is beneficial, as some laundry additives can stain or discolor fabric articles when directly contacted. The secondary distributor can comprise any means for preventing the laundry additive for directly contacting the fabric articles. Secondary distributors include, but are not limited to secondary compartments, absorbent materials, and flexible pouches. In a more preferred embodiment, secondary distributors located outside of the dispenser are functionally attached to the dispenser preferably by a mechanical hinge. The mechanical hinge would allow the secondary distributor to move with the agitation of the automatic washing machine.

In one embodiment the secondary distributor comprises a secondary compartment. The secondary compartment can be made of any material capable of containing a laundry additive. Preferably, the secondary compartment is made out of the same material as the base and/or the reservoir. In one embodiment, the secondary compartment is located within the dispenser and has one or more vents oriented in such a manner that the vents are above the laundry additive deposited into the secondary compartment. As the rinse water begins to fill the drum of the automatic washing machine, the rinse water enters the vents of the secondary compartment through the vent and forces the laundry additive out of the secondary compartment through the vents. Not wishing to be bound by theory, it is believed that the laundry additives are less dense than the rinse water, causing the laundry additives to float atop the rinse water and be forced out of the vents. Further, diffusion mechanisms are also believed to occur and aid in the evacuation of the laundry additive from the secondary compartment. After the rinse cycle, an optional secondary spin cycle then draws any material in the secondary compartment out through the vents by centrifugal force.

In another embodiment, the secondary compartment is located outside of the dispenser and arranged in such a manner that when the laundry additive is released from the dispenser via the exit opening, the laundry additive is released into the secondary compartment through a secondary compartment opening. Without wishing to be bound by theory, it is believed that after the spin cycle, the laundry additive is released from reservoir through the exit opening through the secondary compartment opening into the secondary compartment. During the rinse cycle, the rinse water rises and enters into the secondary compartment via the secondary compartment opening. It is believed that the laundry additives are less dense than the rinse water, causing the laundry additives to float atop the rinse water and be forced through the secondary compartment opening out of the secondary compartment. Further, diffusion mechanisms are also believed to occur and aid in the evacuation of the laundry additive from the secondary compartment. After the rinse cycle, an optional secondary spin cycle then draws any rinse water or laundry additive out of the secondary compartment through the secondary compartment opening by centrifugal force.

In another embodiment the secondary distributor comprises an absorbent material. The absorbent material can comprise any material capable of absorbing laundry additive. In one embodiment, the absorbent material is located outside of the dispenser and arranged in such a manner that when the laundry additive is released from the dispenser via the exit opening, the laundry additive is released onto the absorbent material. Without wishing to be bound by theory, it is believed that after the spin cycle, the laundry additive is released from reservoir through the exit opening onto the absorbent material. During the rinse cycle, the rinse water rises and contacts the absorbent material. It is believed that the rinse water is partially absorbed by the adsorbent material and mixes with the laundry additive. The laundry additive is then carried into the rinse water by diffusion mechanisms. After the rinse cycle, an optional secondary spin cycle then draws any rinse water or laundry additive in the absorbent material out by centrifugal force.

In another embodiment the secondary distributor comprises a flexible pouch. The flexible pouch comprises a deformable pouch having a pouch opening capable of holding a laundry additive. The flexible pouch can be made of any material capable of being deformed by the centrifugal force generated by the spin cycle of the automatic washing machine. Preferred materials are plastics. In one embodiment, the flexible pouch is located outside of the dispenser and arranged in such a manner that when the laundry additive is released from the dispenser via the exit opening, the laundry additive is released into the flexible pouch through the pouch opening. Without wishing to be bound by theory, it is believed that after the spin cycle, the laundry additive is released from reservoir through the exit opening through the pouch opening into the flexible pouch. The flexible pouch contains the laundry additive. During the rinse cycle, the rinse water rises and enters into the flexible pouch via the pouch opening. It is believed that the laundry additives are less dense than the rinse water, causing the laundry additives to float atop the rinse water and be forced through the pouch opening out of the flexible pouch. Further, diffusion mechanisms are also believed to occur and aid in the evacuation of the laundry additive from the flexible pouch. After the rinse cycle, an optional secondary spin cycle then draws any rinse water or laundry additive out of the flexible pouch through the pouch opening by compressing the pouch in on itself and forcing any remaining rinse water or laundry additive through the pouch opening out of the flexible pouch.

The Insert

The insert of the present invention performs the task of substantially sealing the laundry additive in the reservoir until the insert is actuated by the spin cycle centrifugal force. The insert of the present invention has an open position and a closed position. In the closed position, the insert substantially seals the reservoir, allowing less than 30%, more preferably less than 10%, even more preferably less than 5% of the laundry additive, even more preferably less than 1% out of the reservoir when closed. In the open position, the insert allows the flow of the laundry additive between the reservoir and the base, preferably allowing the flow of the laundry additive from the reservoir to the base. The insert in the open position should permit at least 85% by weight, and preferably all, of the contents of the reservoir out of the reservoir onto the base of the dispenser.

The insert of the present invention can be made of any material suitable for placement within an automatic washing machine. Such materials can include, but are not limited to, plastic, metal, ceramic, wood, etc. so long as the structure maintains its shape and mode of operation. A preferred material for the insert is a plastic. Preferred plastics include silicones, polyolefins such as polypropylene, polyethylene, and polybutylene; EPDM (Ethylene Propylene Diene Monomer); composite rubber materials, such as the microdispersed polypropylene/EPDM rubber material commercially available under the trademark Santoprene® from Monsanto Company (St. Louis, Mo.); polyacetals; polyesters, e.g., polybutylene terephthalate; polyamides, e.g., nylon; fluorocarbon polymers, e.g., Teflon® polytetrafluoroethylene (E. I. duPont de Nemours and Company, Inc., Wilmington, Del.); etc., including combinations and composites of such materials, and copolymers of the monomers of such polymers. EPDM is preferred.

The insert of the present invention can be any structure capable of keeping the reservoir substantially sealed during the wash cycle and can be actuated by the spin cycle to allow the laundry additive to move from the reservoir to the base of the dispenser. Such structures may include, but are not limited to, diaphragms, check valves, slit valves, and ball valves. In one embodiment, the insert of the present invention is functionally mounted on the base. In another embodiment, the insert is functionally mounted on the reservoir.

The insert of the present invention is actuated by the spin cycle of the automatic laundry machine. Without being bound by theory, it is believed that during the spin cycle, the insert is actuated by being deformed, deflected, and/or opened toward the interior circumference of the wash drum by centrifugal forces. The actuation of the insert coupled with the centrifugal forces on the laundry additive draws the material out of the reservoir thorough the outlet or the opening, around or through the insert, and onto the base where it is held by the same centrifugal forces. Upon completion of the spin cycle, the insert is reset so that it is in position for the next use. In one embodiment, the insert is manually reset. In another more preferred embodiment, the insert automatically resets itself whereby the automatic resetting is preferably a property of the insert and does not involve any outside intervention.

In a preferred embodiment the insert comprises a diaphragm functionally attached to the base of the dispenser in a manner such that when the reservoir is closed against the base, the diaphragm is seated against the outlet or orifice of the reservoir in a manner where the reservoir is substantially sealed. When the spin cycle begins, it is believed that the diaphragm deflects from the opening or orifice creating a gap. The centrifugal force then draws the laundry additive from the reservoir through the gap created between the orifice or outlet and the diaphragm onto the base. The laundry additive is forced from the reservoir through this gap onto the base. The diaphragm can be made in any shape capable of sealing the reservoir. Preferred shapes for the diaphragm include cones, conicoids, spheres, spheroids, ellipsis, ellipsoids, and disks.

In another preferred embodiment, the insert comprises a slit valve attached to the reservoir of the dispenser. A typical slit valve is made of a plastic having a cross-shaped (cruciform) slit in the center. These slits create flaps that maintain their seal by making contact with each other. When the spin cycle begins, it is believed that the flaps of the slit valve deflect creating a gap between the flaps. The centrifugal force then draws the laundry additive from the reservoir through the orifice or outlet and the gap between the flaps of the slit valve onto the base.

Mounting the Dispenser

The dispenser used in the instant invention can be positioned within the automatic washing machine drum throughout the main washing cycle, spin cycle, and rinse cycles. Generally, the dispenser will be positioned within the automatic washing machine drum in a location such that it will be either above the rinse water or in contact with the rinse water. In one embodiment, the dispenser is substantially submersed by the rinse water.

Positioning of the dispenser may be accomplished by attaching the base to some specific point within the washing machine drum. Preferably, at the beginning of the automatic washing process, the dispenser will be attached to some specific spot within the automatic washing machine drum wherein it will stay during the entire automatic washing process. The dispenser may be positioned on or near the washing machine agitator (if there is one) or may be positioned on the floor (top loaders) or rear wall (front loaders) of the drum. Most preferably, however, the dispenser will be affixed to the inner circumferential wall of the automatic washing machine drum in a position so that at least at some point during the rinse cycles it is in contact with water used in the cycle. For North American washing machines, this position will preferably be below the fill line for rinse water in the drum.

Any means of attaching the device to the drum may be used with this invention. Such attachment means include, but are not limited to, adhesives, including melt adhesives, glues, polymeric, and cements, suction cups, mechanical fasteners such as screws, bolts, and nails, string, magnets, twist-ties, hooks, and Velcro®.

In a preferred embodiment, the housing is attached to the side of the washing machine drum using an attachment means having a curved hook element that can be inserted into an aperture of a washing machine drum. The hook is slidably affixed to the base of the dispenser such that movement of the base is constrained along a line within the structure. Upon insertion of the hook into the aperture of the washing machine drum, the dispenser is slid in such a manner that the dispenser becomes fixed in place. This attachment means is further described in U.S. Provisional Application No. 60/435,646 filed Dec. 20, 2002.

Laundry Additives

For purposes of this invention, "laundry additives" or "rinse additives" can comprise any solid or liquid materials that are conventionally added to the automatic washing machine drum during the rinse cycle of the laundering cycle. Thus the list of suitable "laundry additives" includes, but is not limited to, fabric softeners and conditioners, bleaches, enzymes, bleach and enzyme stabilizers, bleach and enzyme activators, aqueous and non-aqueous solvents, pH adjustment and control agents, dye transfer inhibitors, preservatives, antimicrobial agents, soil release agents, anti-wrinkle agents, chelating agents, optical brighteners, perfumes, pro-perfumes, dyes, and carriers. A more detailed description of various laundry additive materials of both the rinse and wash variety can be found in WO 00/02982 and WO 00/02987.

An especially preferred laundry additive of the present invention includes fabric softeners. Such softeners include, but are not limited to the softeners disclosed in the following patents: U.S. Pat. Nos. 6,559,117; 6,492,322; 6,369,025;

5,981,460; 5,929,025; 5,830,843; 5,747,443; 5,721,202; 5,574,179; 5,562,849; 5,545,350; 5,545,340; 4,767,547; 4,550,862; 4,424,134; 6,500,793; and 6,376,456.

Specific Embodiments

Figure 2:
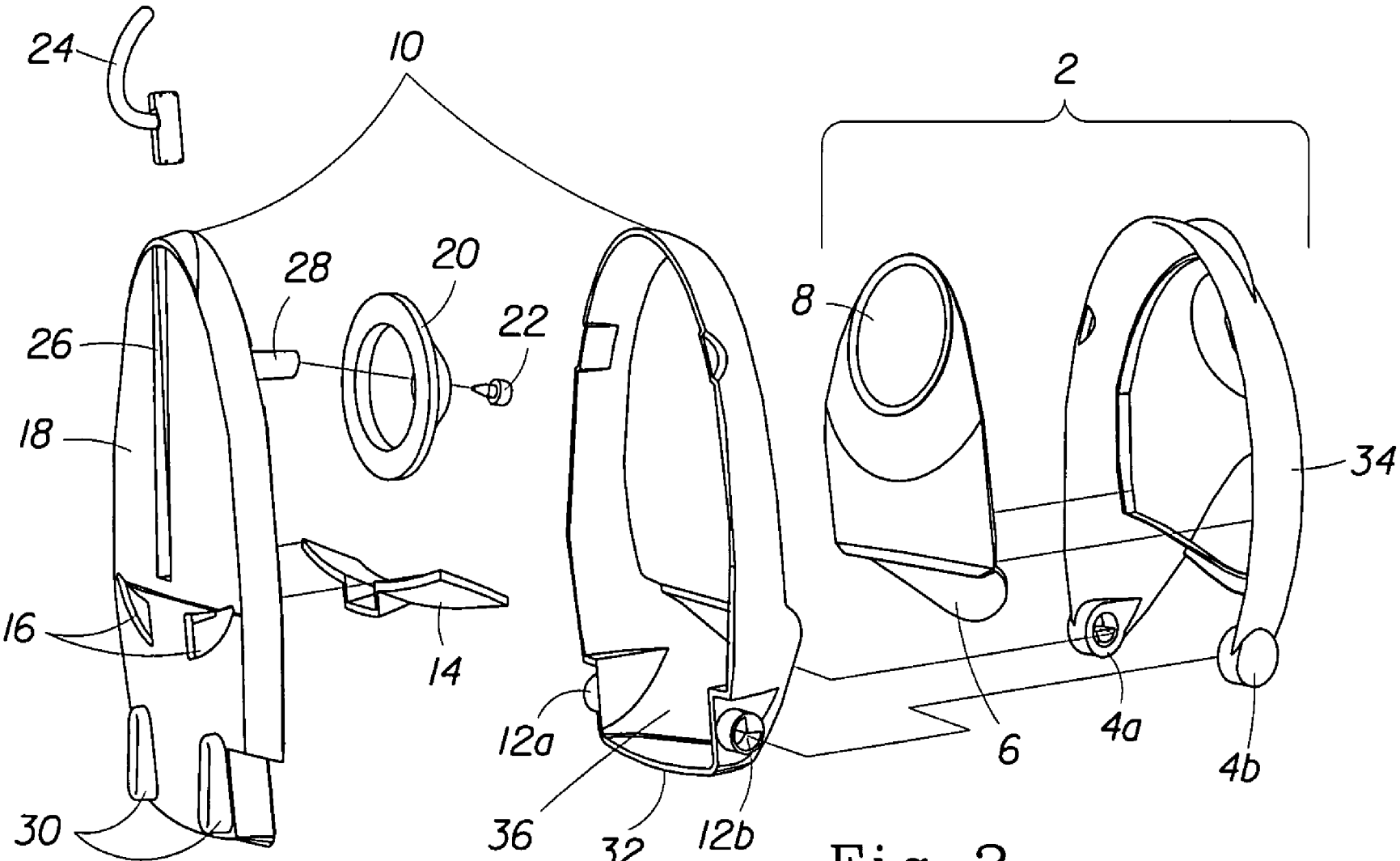
FIG. 2 of the drawings is an exploded rear perspective view showing a first embodiment of the dispenser with a second compartment.

FIGS. 1 and 2 show exploded front and rear perspectives of a dispenser, respectfully. The dispenser comprises a reservoir 2 having a lid 34 and a proximal surface 6 and a base 10 having an upper portion 32 and a lower portion 18. The dispenser is attached to the inside of a laundry drum with a hook 24 that is slideably attached to the lower portion 18 within a groove 26. Feet 30 attached to the lower portion 18 aid in securing the dispenser to the laundry drum.

The reservoir 2 comprises a lid 34 and a proximal surface 6 containing an orifice 8 where laundry additive is added. The base 10 is made of an upper portion 32 containing a secondary compartment 36 and a lower portion 18 with a deflector 14 attached to the lower portion 18 above the vents 16. After the reservoir 2 is filled with laundry additive, the reservoir 2 is folded in such a manner that the orifice 8 meets the insert 20. The insert 20 is functionally attached to the lower portion 18 by a stem 28 and secured with a securing cap 22 above the insert 20. The reservoir 2 and the base 10 are moveably attached to each other via male pivot portions 12*a*, 12*b* and female pivot portions 4*a*, 4*b*.

During the spin cycle, the insert 20 is deflected in the direction of the lower portion 18, thus breaking the seal between the insert 20 and the orifice 8. The force on the laundry additive guides the laundry additive across the surface of the proximal surface 6, through the orifice 8, onto the lower portion 18. After the spin cycle has completed, the laundry additive travels by gravity into the secondary compartment 36. During the rinse cycle, the rinse water rises and enters the dispenser through vents 16 where the interaction between the rinse water and the laundry additive causes the laundry additive to be carried out of the dispenser through the vents 16. A secondary spin cycle draws any remaining material from the secondary compartment 36 through the vents 16.

Figure 3:
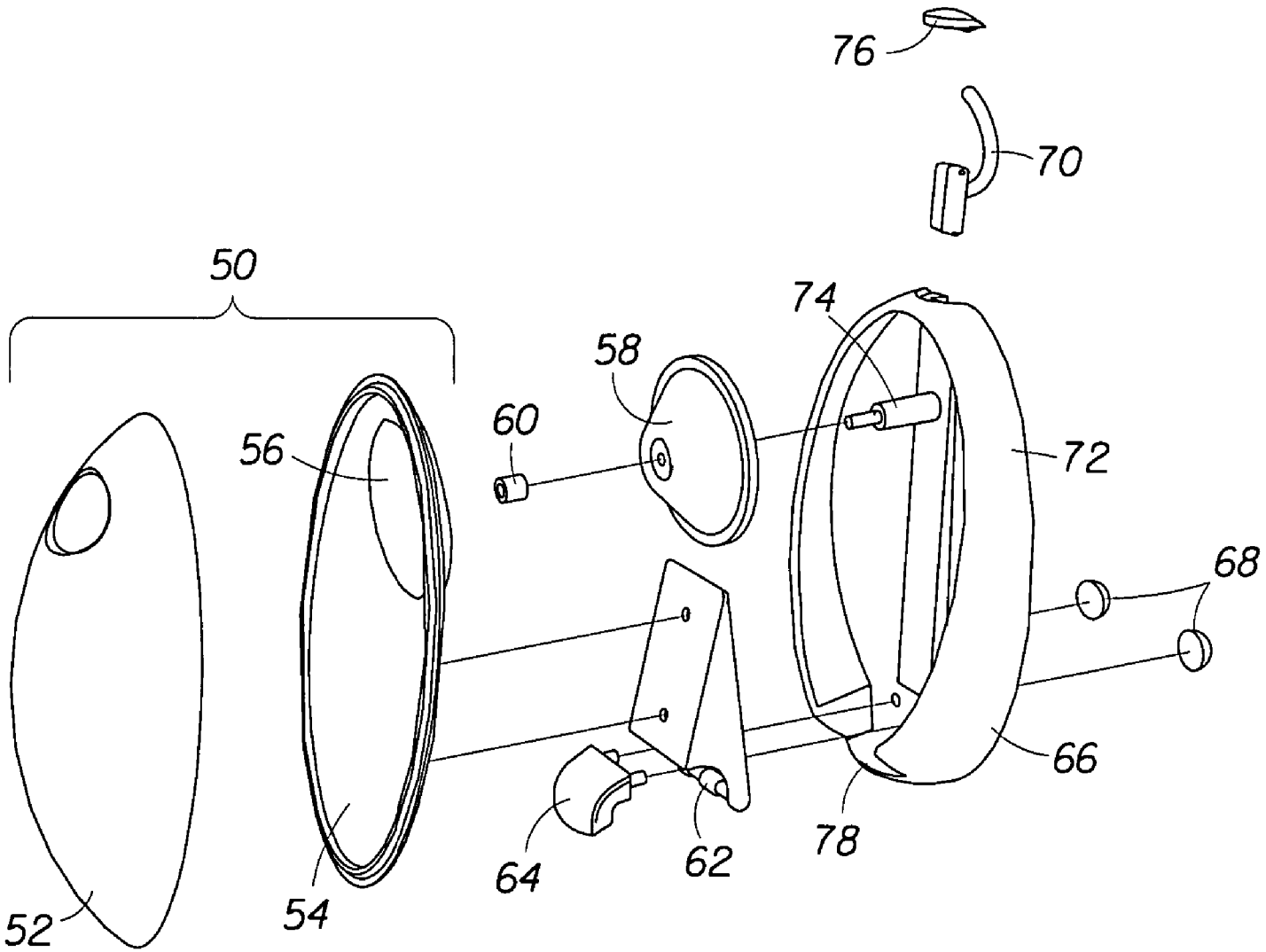
FIG. 3 of the drawings is an exploded front perspective view showing a second embodiment of the dispenser without a second compartment.
Figure 4:
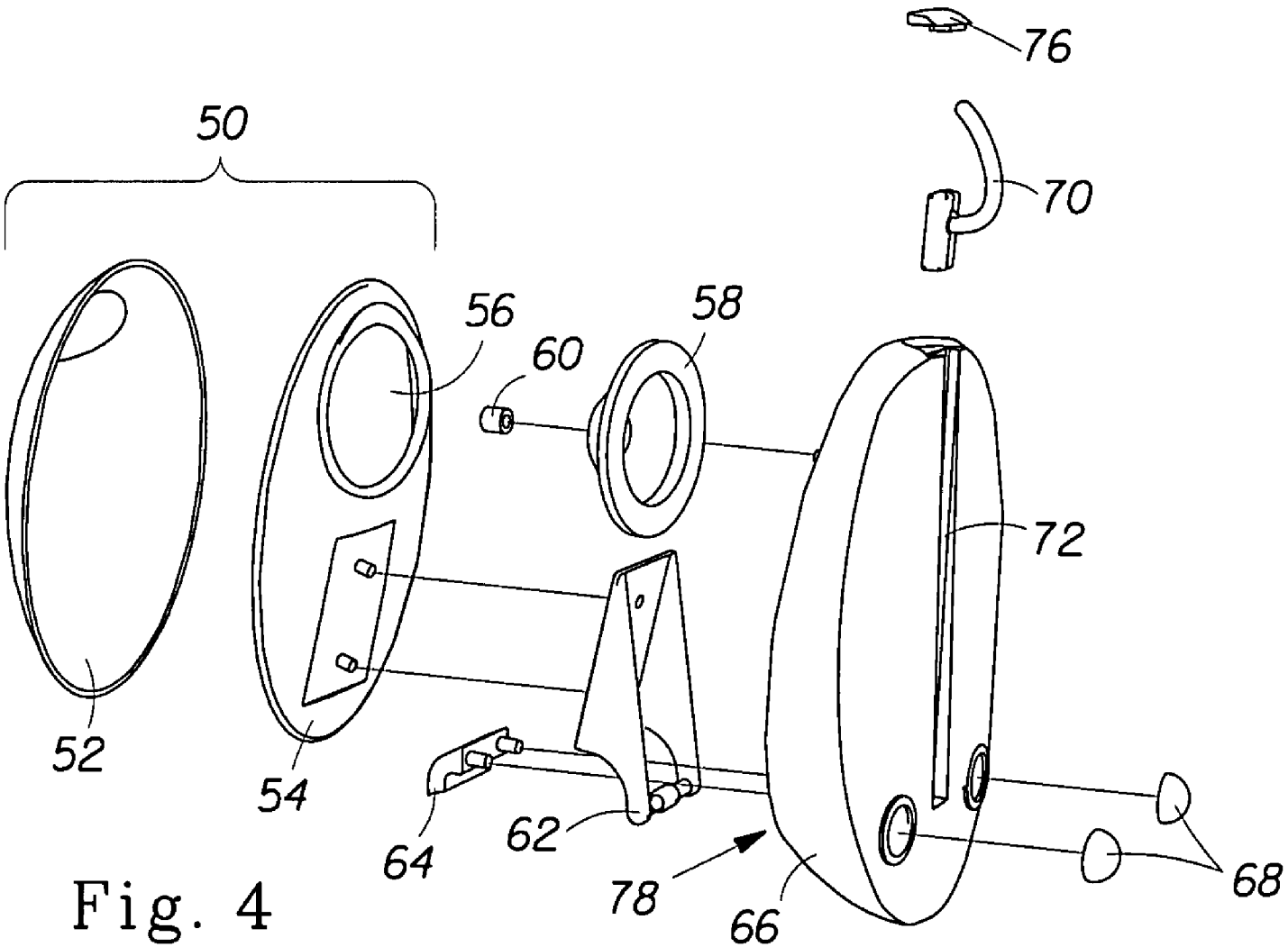
FIG. 4 of the drawings is an exploded rear perspective view showing a second embodiment of the dispenser without a second compartment

FIGS. 3 and 4 show front and rear perspectives of a dispenser, respectfully. The dispenser comprises a reservoir 50 having a top 52 and a proximal surface 54 and a base 66. The dispenser is attached to the inside of a laundry drum with a hook 70 that is slideably attached to the base 66 within a groove 72, the groove 72 being closed by a blocking portion 76. Feet 68 attached to the base 66 aid in securing the dispenser to the laundry drum.

The reservoir 50 comprises a top 52 and a proximal surface 54 containing an orifice 56 where laundry additive is added. After the reservoir 50 is filled with laundry additive, the reservoir 50 is folded in such a manner that the orifice 56 meets the insert 58. The insert 58 is functionally attached to the base 66 by a stem 74 and secured with a securing cap 60 above the insert 58. The reservoir 50 and the base 66 are moveably attached to each other via a reservoir hinging member 62 fixably attached to the reservoir 50 and functionally attached to a base hinging member 64 fixably attached to the base 66.

During the spin cycle, the insert 58 is deflected in the direction of the base 66, thus breaking the seal between the insert 58 and the orifice 56. The force on the laundry additive guides the laundry additive across the surface of the proximal surface 54, through the orifice 56, onto the base 66. After the spin cycle has completed, the laundry additive travels by gravity down the base 66 and exits through an exit opening 78.

All documents cited in the Detailed Description of the Invention are, are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A dispenser for laundry additives comprising a reservoir having an orifice and a base, said reservoir and base being separated by a diaphragm, said base comprising an upper portion containing a secondary compartment and a lower portion with a deflector attached to the lower portion above vents, wherein the reservoir and the base are moveably attached to each other with pivot portions, wherein the diaphragm is attached to the base by a stem and seals said orifice; and said dispenser is affixed to a washing machine drum by an attachment means, whereby during the spin cycle of said washing machine said diaphragm is deflected by centrifugal force in the direction of said lower portion to break the seal of said orifice and said laundry additive flows onto said lower portion and, after the spin cycle is complete, said additive travels into the secondary compartment, and whereby during the rinse cycle of the washing machine rinse water enters the dispenser through said vents and said additives are carried out of said dispenser by said rinse water through said vents and into the drum of said washing machine.

2. The dispenser of claim 1, wherein the reservoir is made of plastic.

3. The dispenser of claim 2, wherein the plastic is a low surface energy plastic, wherein the low surface energy is less than 52 dynes/cm.

4. The dispenser of claim 3, wherein the low surface energy plastic is selected from the group consisting of polyolefins, EPDM, polyacetals; polyesters; polyamides; and combinations, composites and copolymers thereof.

5. The dispenser of claim 1, wherein the base is made of plastic; and a securing cap secures the diaphragm attached to the base by the stem.

6. The dispenser of claim 5 wherein the plastic is a low surface energy plastic, wherein the low surface energy is less than 52 dynes/cm.

7. The dispenser of claim 6, wherein the low surface energy plastic is selected from the group consisting of polyolefins, EPDM, polyacetals; polyesters; polyamides;

and combinations, composites and copolymers thereof.

8. The dispenser of claim 1, wherein the reservoir has a volume of 0.5 ml to about 1000 ml.

9. The dispenser of claim 1, wherein the diaphragm is made of plastic.

10. The dispenser of claim 9, wherein the plastic is selected from the group consisting of silicone, polyoletins, EPDM, polyacetals; polyesters; polyamides; and combinations, composites and copolymers thereof.

11. The dispenser of claim 9, wherein the diaphragm is made of EPDM.

12. The dispenser of claim 1, wherein the diaphragm has a shape chosen from a cone, conicoid, sphere, spheroid, ellipsis, ellipsoids, or disk.

13. The dispenser of claim 12, further comprising a securing cap capping the stem thereby securing the diaphragm attached to the lower portion by the stem; and wherein the diaphragm has a shape chosen from a cone, conicoid, sphere, spheroid, ellipsis, ellipsoids, or disk.

14. The dispenser of claim 13, further comprising a distributor, wherein the distributor is located within the dispenser; and wherein the reservoir further comprises an orifice, wherein the diaphragm seals the orifice.

* * * * *

UNITED STATES PATENT AND TRADEMARK OFFICE

CERTIFICATE OF CORRECTION

PATENT NO. : 7,971,457 B2
APPLICATION NO. : 10/986947
DATED : July 5, 2011
INVENTOR(S) : Yousef Georges Aouad It is certified that error appears in the above-identified patent and that said Letters Patent is hereby corrected as shown below:

Column 12, Claim 10
Line 2, delete "polyoletins" and insert -- polyolefins --.

Signed and Sealed this
Sixteenth Day of October, 2012

David J. Kappos

David J. Kappos
*Director of the United States Patent and Trademark Office*